US006923935B1

(12) United States Patent
Donahue et al.

(10) Patent No.: US 6,923,935 B1
(45) Date of Patent: Aug. 2, 2005

(54) HYPOEUTECTIC ALUMINUM-SILICON ALLOY HAVING REDUCED MICROPOROSITY

(75) Inventors: Raymond J. Donahue, Fond du Lac, WI (US); Terrance M. Cleary, Fond du Lac, WI (US); Kevin R. Anderson, Fond du Lac, WI (US)

(73) Assignee: Brunswick Corporation, Fond du Lac, WI (US)

( * ) Notice: Subject to any disclaimer, the term of this patent is extended or adjusted under 35 U.S.C. 154(b) by 0 days.

(21) Appl. No.: 10/429,098

(22) Filed: May 2, 2003

(51) Int. Cl.[7] ..... C22C 21/04
(52) U.S. Cl. ..... 420/546; 420/547; 420/549; 148/415
(58) Field of Search ..... 420/546, 547, 420/549; 148/415

(56) References Cited

U.S. PATENT DOCUMENTS

| | | | | |
|---|---|---|---|---|
| 4,969,428 A | | 11/1990 | Donahue et al. | 123/195 |
| 5,009,844 A | | 4/1991 | Laxmanan | 420/548 |
| 5,023,051 A | | 6/1991 | Lindberg | 420/549 |
| 5,234,514 A | | 8/1993 | Donahue et al. | 148/549 |
| 6,139,654 A | | 10/2000 | Boone et al. | 148/441 |
| 6,221,504 B1 | | 4/2001 | Pfeffinger et al. | 428/564 |
| 6,267,829 B1 | * | 7/2001 | Backerud et al. | 148/415 |
| 6,355,213 B1 | * | 3/2002 | Takasaki et al. | 420/546 |
| 6,364,970 B1 | | 4/2002 | Hielscher et al. | 148/440 |
| 6,402,860 B2 | | 6/2002 | Hashikura et al. | 148/440 |

OTHER PUBLICATIONS

"Aluminum and Aluminum Alloys", ASM International, 1993, p 98.*

"ASM Handbook: vol. 18 Friction, Lubrication, and Wear Technology", ASM International, pp 785–790 (1993).*

* cited by examiner

*Primary Examiner*—George Wyszomierski
*Assistant Examiner*—Janelle Morillo
(74) *Attorney, Agent, or Firm*—Andrus, Sceales, Starke & Sawall, LLP

(57) ABSTRACT

A hypoeutectic aluminum silicon casting alloy having a refined primary silicon particle size and a modified iron morphology. The alloy includes 10 to 11.5% by weight silicon, 0.10 to 0.70% by weight magnesium and also contains 0.05 to 0.07% by weight strontium. On cooling from the solution temperature, the strontium serves to modify the silicon eutectic structure as well as create an iron phase morphology change. Such changes facilitate feeding through the aluminum interdendritic matrix. This, in turn, creates a finished die cast product with extremely low levels of microporosity defects. The alloy may be used to cast engine blocks for marine outboard and stern drive motors. Furthermore, when the magnesium levels are adjusted to approximately 0.10 to 0.20% by weight magnesium, propellers having a highly advantageous ductility may be obtained.

5 Claims, No Drawings

HYPOEUTECTIC ALUMINUM-SILICON ALLOY HAVING REDUCED MICROPOROSITY

BACKGROUND OF THE INVENTION

Aluminum silicon alloys containing less than about 11.6% by weight of silicon are referred to as hypoeutectic alloys, while alloys containing more than 11.6% silicon are referred to as hypereutectic alloys.

Hypoeutectic aluminum silicon alloys, those containing less than 11.6% silicon, have a microstructure consisting of primary aluminum dendrites with a eutectic composed of acicular silicon in an aluminum dendritic matrix.

Hypoeutectic aluminum silicon alloys often contain iron to prevent "sticking" of the alloy to steel casting molds, when such alloys are used in traditional die casting methods. In the microstructure of such alloys, the iron occurs as elongated needle-like structures.

The solidification range, which is a temperature range over which the alloy will solidify, is the range between the liquidus temperature and the invariant eutectic temperature. The wider or greater the solidification range, the longer it will take an alloy to solidify at a given rate of cooling. During a hypoeutectic aluminum silicon alloy's descent through the solidification range, the aluminum dendrites are the first to form. As time elapses and the cooling process proceeds, the aluminum dendrites grow larger, eventually touch, and form a dendritic network. During this time frame, elongated iron needle-like structures also form and tend to clog the narrow passageways of the aluminum dendritic network, restricting the flow of eutectic liquid. Such phenomena tends to increase the instance of microporosity in the final cast structure. A high degree of microporosity is undesirable, particularly when the alloy is used for engine blocks, because high microporosity causes leakage under O-ring seals on machined head deck surfaces, and lowers the torque carrying capacity of machined threads. Further, hypoeutectic aluminum silicon alloy engine blocks are designed to have electro-deposited material, such as chromium, on the cylinder bore surfaces for wear resistance. However, the aforementioned microporosity prevents the adhesion of the electro-deposited chrome plating. Similarly, a hypereutectic aluminum silicon alloy, cast using a high pressure die casting method, also produces a porous structure in the parent bore material that contributes to high oil consumption.

Therefore, it would be advantageous to reduce the iron needle-like structure as well as the silicon eutectic particle size to facilitate interdendritic feeding and correspondingly reduce microporosity.

Hypoeutectic aluminum silicon alloys generally have poor ductility because of the large irregular shape of the acicular eutectic silicon phase. It has been recognized that the growth of the eutectic silicon phase can be modified by the addition of small amounts of sodium or strontium, thereby increasing the ductility of the hypoeutectic aluminum silicon alloy. Such modification further reduces microporosity as the smaller eutectic silicon phase structure facilitates interdendritic feeding.

U.S. Pat. No. 5,234,514 relates to a hypereutectic aluminum silicon alloy having refined primary silicon and a modified eutectic. The aforementioned patent is directed to modifying the primary silicon phase and the silicon phase of the eutectic through the addition of phosphorus and a grain refining substance. When this alloy is cooled from solid solution to a temperature beneath the liquidus temperature, the phosphorus acts in a conventional manner to precipitate aluminum phosphide particles, which serve as an active nucleant for primary silicon, thus producing smaller refined primary silicon particles having a size generally less than 30 microns. However, the '514 patent indicates that the same process could not be used with a hypereutectic aluminum silicon alloy modified with sodium or strontium, because the sodium and strontium neutralize the phosphorous effect, and the iron content of the alloy still causes precipitation of the iron phase that hinders interdendritic feeding.

U.S. Pat. No. 6,364,970 is directed to a hypoeutectic aluminum-silicon alloy. The alloy according to the '970 patent contains an iron content of up to 0.15% by weight and a strontium refinement of 30 to 300 ppm (0.003 to 0.03% by weight). This hypoeutectic alloy has a high fracture strength resulting from the refined eutectic silicon phase resulting from the addition of strontium to the alloy.

Hypereutectic aluminum silicon alloys have been used to produce engine blocks for outboard and stern drive motors in the recreation boating industry. Such alloys are advantageous for use in engine blocks as they provide a high tensile strength, high modulus, low coefficient of thermal expansion, and are resistant to wear.

High pressure die cast hypoeutectic aluminum silicon alloys have seen limited use for marine propellers as they are brittle and lack ductility. Due to their greater ductility, aluminum magnesium alloys are in general used for marine propellers. Aluminum magnesium alloys are advantageous as they provide high ductility and durability, but the repairability of such aluminum magnesium propellers is limited. The addition of magnesium to aluminum silicon alloys has been found to increase the ductility of propellers while providing an advantageous degree of durability. Still, it has been found that aluminum magnesium alloys are significantly more expensive to die cast into propellers because the casting temperature is significantly higher and because the scrap rate is much greater.

For cost and geometrical tolerance reasons, propellers for outboard and stern drive motors are traditionally cast using high pressure die cast processes. However, propellers may also be cast using a more expensive semi-solid metal (SSM) casting process. In the SSM process, an alloy is injected into a die at a suitable temperature in the semi-solid state, much the same way as in high pressure die casting. However, the viscosity is higher and the injection speed is much lower than in conventional pressure die casting, resulting in little or no turbulence during die filling. The reduction in turbulence creates a corresponding reduction in microporosity.

Regardless of how such propellers are cast, propellers regularly fracture large segments of the propeller blades when they collide with underwater objects during operation. This is due to the brittleness of traditional propeller alloys.

As a result, the damaged propeller blades cannot be repaired as the missing segments are lost at the bottom of the body of water in which the propeller was operated. Furthermore, the brittleness inherent in traditional aluminum-silicon alloys prevents efficient restructuring of the propellers through hammering. Thus, it is desirable to provide a propeller that only bends, but does not break upon impact with an underwater object.

SUMMARY OF THE INVENTION

The invention is directed to an iron-containing, high pressure die casting hypoeutectic aluminum silicon alloy containing by weight 9 to 11.5% silicon, 0.10 to 0.70% magnesium, 0.20 to 1.3% iron, 0.2 to 0.3% manganese, 0.05 to 0.07% strontium, less than 0.15% copper, less than 0.07% titanium, less than 0.001% phosphorus, less than 0.01% zinc, less than 0.01% nickel, less than 0.01% tin, less than 0.01% lead, and the balance aluminum.

The magnesium level may be modified depending on the use desired for the alloy. For use in engine blocks, requiring high tensile strength, the magnesium level will be on the high end of the range. For use in marine propellers, requiring high ductility, the magnesium level will be on the low end of the range, as for example, 0.10 to 0.20% by weight. The silicon level is relatively high for two reasons, for fluidity and for the high volume fraction of eutectic, which will have a modified eutectic silicon phase.

Quite unexpectedly, the very high levels of strontium used in the aluminum silicon alloy have been found to affect the microstructure and increase the interdendritic feeding. It was expected that the addition of the very high levels of strontium would result in modified eutectic silicon through its influence on interdendritic feeding. Quite unexpectedly, the addition of the very high levels of strontium causes an iron phase morphology change. Specifically, the needle-like structures distinctive of traditional iron morphology are reduced to smaller spherodized particles.

The presence of the modified eutectic silicon and the iron phase morphology change has significant effects on interdendritic feeding. Movement through the aluminum interdendritic matrix is facilitated with the smaller eutectic silicon and iron phase particles. This increased interdendritic feeding has been found to significantly reduce the microporosity in cast engine blocks.

Microporosity is undesirable as it causes leakage under O-ring seals on the machined head deck surface of engine blocks, lowers the torque carrying capacity of threads, and severely compromises the ability for plating bores or for parent bore application. Thus, engine blocks with appreciable microporosity are scrapped. The reduction in microporosity results in reduction of scrap blocks which, in turn, results in a more highly economic production of cast engine blocks.

Therefore, the alloy disclosed herein may be incorporated into a relatively inexpensive process for producing a high volume, high quality, low microporosity, engine blocks. The microporosity is lowered by increased levels of strontium in the alloy. Such increased levels reduce the size of eutectic silicon particles and simultaneously modify the iron needle morphology during cooling to facilitate interdendritic feeding. Further, the alloy, with the modified eutectic silicon phase and modified iron phase, and having levels of magnesium between 0.1 and 0.2% by weight, has impact properties that make the alloy ideal for high pressure die casting of propellers.

Various other features, objects, and advantages of the invention will be made apparent from the following detailed description.

DETAILED OF THE PREFERRED EMBODIMENT

The hypoeutectic aluminum silicon alloy of the invention has the following formulation in weight percent:

| Element | Range of Percentages |
|---|---|
| Silicon | 9 to 11.5% |
| Magnesium | 0.10 to 0.70% |
| Iron | 0.20 to 1.3% |
| Manganese | 0.2 to 0.3% |
| Strontium | 0.05 to 0.07% |
| Copper | 0.15% maximum |
| Titanium | 0.07% maximum |
| Zinc | 0.01% maximum |
| Nickel | 0.01% maximum |
| Tin | 0.01% maximum |
| Lead | 0.01% maximum |
| Phosphorus | 0.001% maximum |
| Aluminum | Balance |

As the hypoeutectic alloy is cooled from solution to a temperature below the liquidus temperature, aluminum dendrites begin to appear. As the temperature decreases and solidification proceeds, the dendrites increase in size and begin to form an interdendritic network matrix. Additionally, during the solidification process, relatively equiaxed iron structures form concurrently.

According to the invention, the high levels of strontium significantly modify the microstructure of the alloy. The strontium addition of 0.05 to 0.07% by weight effectively modifies the eutectic silicon. In a conventional hypoeutectic aluminum silicon alloy, the eutectic silicon particles are large and irregular in shape. Such large eutectic silicon particles precipitate into large acicular shaped silicon crystals in the solidified structure, rendering the alloy brittle. The strontium addition modifies the eutectic silicon structure by effectively reducing the size of the eutectic silicon particles.

Furthermore, and quite unexpectedly, the strontium addition of 0.05 to 0.07% by weight modifies the iron phase shape morphology. Conventionally, the iron phase morphology is needle-like in shape. The strontium addition modifies the iron phase morphology by reducing the iron needles of the microstructure into smaller, blocky, angular, yet spherodized particles.

The presence of modified eutectic silicon and the iron phase morphology change have significant effects on interdendritic feeding. The reduction in size of the eutectic silicon particles, along with the reduction in size of the iron phase structures into smaller, blocky, angular, yet spherodized particles, greatly facilitates liquid metal movement through the interdendritic aluminum matrix during cooling. As a result, the increased interdendritic feeding has been found to significantly reduce the microporosity in cast engine blocks.

The lowering of the microporosity in the microstructure of the cooled aluminum silicon alloy product greatly reduces the number of blocks that fail to meet porosity specifications. Microporosity is undesirable as it results in leakage of O-ring seals, reduction in the strength of threads, surfaces incapable of metal plating during production, and for parent bore applications, high oil consumption. Thus, engine blocks with substantial microporosity defects are scrapped. With the alloy of the current invention, it is anticipated that a scrap reduction of up to 70% may be obtained solely through the use of this new and novel alloy. The reduction of blocks that fail to meet the porosity specification corresponds to the reduction in amount of blocks scrapped, which in turn, results in a more highly economic production of cast engine blocks.

Additionally, the other elements present in the alloy formulation contribute to the unique physical qualities of the final cast products. Specifically, the low phosphorus content keeps the phosphorus-strontium interaction at a minimum. Also, the maximum range on the titanium addition signifies an added factor in grain refinement.

When casting engine blocks using the aluminum silicon alloy of the present invention, the alloy demonstrates significant advantages in its physical properties. In the as cast condition, at 0.15% magnesium by weight, yield strength is 17 KSI, ultimate tensile strength is 35 KSI and elongation in 2 inches is 11%. At 0.30% by weight magnesium, yield strength is 18 KSI, ultimate tensile strength is 39 KSI and elongation in 2 inches is 9%. At 0.45% magnesium by weight, yield strength is 21 KSI, ultimate tensile strength is 42 KSI and elongation in 2 inches is 6%.

Aging the as cast alloy containing 0.30% magnesium by weight four to eight hours at 340° F. provides a yield strength of 28 KSI, an ultimate tensile strength of 45 KSI and an elongation in 2 inches of 9%. With this T5 heat treatment condition, no loss of ductility occurs over the as cast condition, and the ultimate tensile strength is increased by 15%, while the yield strength is increased by 50%. With T5 treatment, no solution heat treatment is effected.

The T6 heat treatment condition, aged at 340° F. for four to eight hours, increases the yield strength to 35 KSI, an increase of nearly 100% over the as cast condition, with no loss in ductility over the as cast condition. However, in the T6 heat treatment condition, solution heat treatment is effected, and some blistering may occur during the solution heat treating.

The T7 heat treatment condition, aged at 400° F. for four to eight hours with solution heat treatment, and the T4 heat treatment condition, aged at room temperature for four to eight hours without solution heat treatment, both increase the elongation in 2 inches over 100% compared to the as cast condition while maintaining the equivalent yield strength of the as cast condition.

Hypoeutectic aluminum silicon alloys of the invention can be employed to cast engine blocks for outboard and stern drive marine motors. When such engines are to be cast, the magnesium level of the alloy is preferably kept in the range of 0.20–0.50% by weight.

EXAMPLE 1

An alloy was prepared having the following composition in weight percent: 11.1% silicon, 0.61% magnesium, 0.85% iron, 0.09% copper, 0.22% manganese, 0.16% titanium, 0.055% strontium and the balance aluminum. Thirty-six four-cylinder cast engine blocks were then produced from this alloy.

A control lot was prepared using an alloy having the following composition in weight percentage: 11.1% silicon, 0.61% magnesium, 0.85% iron, 0.09% copper, 0.22% manganese, 0.16% titanium and the balance aluminum. Significantly, no strontium was added to this alloy. Thirty-eight four-cylinder blocks were die cast under identical conditions as the blocks of the first alloy using a 1200 ton die casting machine. The only difference between the two sets of blocks is that the first set contained 0.055% by weight strontium and the control lot contained no strontium.

The control lot and the strontium-containing lot were machined and all machined surfaces, threaded holes and dowel pin holes were inspected according to a stringent porosity specification that allowed only two instances of porosity of a size that could extend across two thread spacings for certain M6, M8 and M9 threads.

The thirty-eight control lot blocks produced eight blocks with microporosity defects, a percentage of 21.1%. Of those eight blocks with defects, seven of those blocks failed the porosity specification. Those seven blocks were scrapped, indicating an 18.4% scrap rate for the control lot.

In comparison, the strontium containing lot produced four of thirty-six blocks with defects, a percentage of 11.1%. Of those four blocks, only two were required under the porosity specification to be scrapped. Thus, the scrap rate for the strontium containing lot was 5.6%.

The magnitude of scrap reduction, a reduction of 70% from 18.4% to 5.6% is an unexpected, yet extremely useful result indicating the high strontium level influence in reducing microporosity. This reduction in scrap is essential to a highly economic production of cast engine blocks.

EXAMPLE 2

An alloy was preparing having the following composition in weight percent: 10.9% silicon, 0.63% magnesium, 0.87% iron, 0.08% copper, 0.24% manganese, 0.14% titanium, 0.060% strontium, and the balance aluminum. Forty 2.5 L V-6, two stroke engine blocks were prepared from this alloy.

A control lot was prepared using an alloy having the following composition in weight percentage: 10.9% silicon, 0.63% magnesium, 0.87% iron, 0.08% copper, 0.24% manganese. 0.14% titanium, and the balance aluminum. Significantly, no strontium was added to this alloy. Thirty-three 2.5 L V-6, two stroke engine blocks were prepared from this alloy.

Both lots were die cast under identical conditions using a 2500 ton die casting machine, at the same time, and were sequentially numbered. The only difference between the two lots is that the first lot contained 0.060% by weight strontium while the control lot contained no strontium. Both lots were machined together.

The head decks of the engine blocks were examined for microporosity defects. Engine blocks with microporosity defects having a range of 0.010 inches to 0.060 inches in diameter were repaired. Blocks with microporosity defects larger than 0.060 inches in diameter were scrapped. This stringent porosity standard is necessary as an O-ring seal must be placed on the head decks of the engine blocks. Any significant microporosity defects provide opportunity for leakage beneath the O-ring seal.

Thirty-three control lot engine blocks produced sixteen blocks that were scrapped as a result of microporosity defects, a percentage of 48%. In comparison, the lot of forty strontium containing engine locks produced fourteen blocks which were scrapped as a result of microporosity defects, a percentage of 35%.

The magnitude of scrap reduction for this example is 27%, from 48% to 35%. This reduction in scrap due to microporosity defects indicates that the addition of strontium has an extremely useful, while unexpected result. This fundamental effect of lowering microporosity defects is unmistakable and results in a reduction of scrap that is essential to a highly economic production of cast engine blocks.

EXAMPLE 3

An alloy was prepared having the following composition in weight percent: 11.3% silicon, 0.63% magnesium, 0.81% iron, 0.10% copper, 0.25% manganese, 0.11% titanium, 0.064% strontium, and the balance aluminum. Thirty-seven 2 L, 4 stroke engine blocks were prepared from this alloy.

A control lot was prepared using an alloy having the following composition in weight percentage: 11.3% silicon, 0.63% magnesium, 0.81% iron, 0.10% copper, 0.25% manganese, 0.11% titanium, and the balance aluminum. Significantly, no strontium was added to this alloy. Twenty-five 2 L, 4 stroke engine blocks were prepared from this alloy.

Both lots were die cast under identical conditions using a different die casting machine than the first two examples. The lots were cast at the same time, and were sequentially numbered. The only difference between the two lots is that the first lot contained 0.064% by weight strontium, while the control lot contained no strontium.

The head decks of the engine blocks were examined for microporosity defects. All machined surfaces, threaded holes and dowel pin holes were inspected. Engine blocks with microporosity defects having a range of 0.010 inches to 0.060 inches in diameter were repaired. Blocks with microporosity defects larger than 0.060 inches in diameter were scrapped.

Twenty-five control lot engine blocks produced twenty blocks with defects, a percentage of 80.0%. Six of the defective blocks were scrapped, resulting in a scrap percentage of 24.0%. In comparison, the lot of thirty-seven strontium containing engine blocks produced twenty-eight blocks with microporosity defects, a percentage of 75.7%. Only five of the thirty-seven blocks had to be scrapped, a scrap percentage of 13.5%.

The magnitude of scrap reduction for this example is 44%, from 24% to 13.5% on a very tough porosity specification. Although 0.010% by weight strontium is more than sufficient to produce the eutectic silicon phase modification noted earlier, this amount of strontium is insufficient to lower the porosity level or the scrap identified above. Therefore, the results identified in the above experiments are unexpected, particularly the magnitude of reduction of the scrapped blocks.

The hypoeutectic aluminum silicon alloy of the present invention may also be used to cast propellers for marine outboard and stern drive motors used in the recreational boating industry. When the alloy of the present invention is intended for this use, the magnesium level is maintained at 0.10 to 0.20% by weight, providing an alloy that is ductile yet durable for use in the propeller. The utilization of this alloy modification with SSM casting processes has been found to produce propellers for outboard and stern drive motors with higher ductility.

Traditionally, semi-solid metal (SSM) casting is utilized for high pressure die cast designs that need higher strength, and therefore, are subject to higher heat treatment conditions. It has been discovered that using the aluminum—silicon alloy of the present invention with SSM for the high pressure die casting of marine propellers attains the quality of high ductility. The SSM casting process is advantageous as the aluminum silicon alloy of the present invention will naturally age at room temperature to a higher strength and lower ductility. To counteract the natural aging, it has been found that heating the alloy after quenching to a temperature in the range of 650° F. to 900° F. spherodizes the eutectic silicon microstructure and decreases the tendency of the microstructure to naturally age after quench from the solution heat treatment temperature. When propellers are cast using the SSM process and subsequently heat treated as described above, propellers with surprisingly high ductility were obtained, having an elongation in 2 inches of 15% to 20%.

High ductility is desirable in propellers so that the propeller will bend, but not break, upon impact with an underwater object. As a result, the damaged propeller blades may be more easily repaired. The propellers will not fracture into segments in collisions with underwater objects and may be hammered back into shape.

Propellers in a T7 heat treated condition and made from the alloy of the invention have been found to have significant advantages in physical properties when compared to conventional propellers. Specifically, the ultimate tensile strength is 34 to 38 psi, the yield strength is 20,000 to 24,000 psi and the elongation in 2 inches is 12% to 20%.

It is recognized that other equivalents, alternatives, and modifications aside from those expressly stated, are possible and within the scope of the appended claims.

What is claimed is:

1. A hypoeutectic aluminum silicon die-cast alloy, consisting essentially of 9 to 11.5% by weight of silicon, 0.10 to 0.70% by weight of magnesium, 0.20 to 1.3% by weight iron, 0.2 to 0.3% by weight manganese, 0.05 to 0.07% by weight strontium, 0.15% by weight maximum copper, 0.16% by weight maximum titanium, 0.01% maximum by weight of zinc, 0.01% maximum by weight of nickel, 0.01% maximum by weight of tin, 0.01% maximum by weight of lead, 0.001% maximum by weight phosphorus, and the balance aluminum.

2. The alloy of claim 1 wherein said alloy has a metallographic structure comprising modified eutectic silicon particles, and refined iron containing particles.

3. An engine block composed of a hypoeutectic aluminum silicon, die cast alloy consisting essentially of 9 to 11.5% by weight silicon, 0.20 to 0.50% by weight magnesium, 0.20 to 1.3% by weight iron, 0.2 to 0.3% by weight manganese, 0.05 to 0.07% by weight strontium, 0.15% by weight maximum copper, 0.16% by weight maximum titanium, 0.01% maximum by weight of zinc, 0.01% maximum by weight of nickel, 0.01% maximum by weight of tin, 0.01% maximum by weight of lead, 0.001% maximum by weight phosphorus and the balance aluminum.

4. The alloy of claim 3 wherein said alloy has a metallographic structure comprising modified eutectic silicon particles, and refined iron containing particles.

5. A marine propeller composed of a hypoeutectic aluminum silicon die cast alloy consisting essentially of 9 to 11.5% by weight silicon, 0.10 to 0.20% by weight magnesium, 0.20 to 1.3% by weight iron, 0.2 to 0.3% by weight manganese, 0.05 to 0.07% by weight strontium, 0.15% maximum by weight copper, 0.16% maximum by weight titanium, 0.01% maximum by weight zinc, 0.01% maximum by weight nickel, 0.01% maximum by weight tin, 0.01% maximum by weight lead, 0.001% maximum by weight phosphorus and the balance aluminum.

* * * * *